US005957205A

United States Patent [19]

Bohme et al.

[11] Patent Number: 5,957,205

[45] Date of Patent: Sep. 28, 1999

[54] SAND EXCLUSION LINER AND METHOD OF USING THE SAME

[75] Inventors: Calvin G. Bohme; Richard W. Luhning, both of Calgary; Gordon M. Trefenanko, Blackfoot, all of Canada

[73] Assignee: Alberta Oil Sands Technology and Research Authority, Calgary, Canada

[21] Appl. No.: 08/912,054

[22] Filed: Aug. 18, 1997

[51] Int. Cl.[6] ..... E21B 43/10

[52] U.S. Cl. ..... 166/296; 166/227

[58] Field of Search ..... 166/296, 376, 166/227, 233, 50

[56] References Cited

U.S. PATENT DOCUMENTS 5,287,923 2/1994 Cornette et al. ..... 166/278
5,339,895 8/1994 Arterbury et al. ..... 166/227

*Primary Examiner*—David J. Bagnell
*Assistant Examiner*—Sunil Singh
*Attorney, Agent, or Firm*—Sheridan Ross P.C.

[57] ABSTRACT

A conventional screened liner is modified to enable fluid circulation through its length when working it toward a landing position in a horizontal wellbore. At surface, a sleeve of heat-liquifiable sealant (such as wax or tar) is formed internally in each perforated liner joint to blind the liner openings. The sleeve may have a central longitudinal bore formed therethrough or alternatively the sleeve is bored out to fully re-open the joint bore. In either case, the bore through the blinded joints enable circulating the liner into the wellbore. Once the liner is in place, the sealant can be removed by circulating steam past it to liquify it. By providing bore-forming blinded screen joints, it is now possible to circulate through the entire length of liner to remove sand blockages without reversing fluid flow through the liner openings.

5 Claims, 5 Drawing Sheets

FIG. 2.
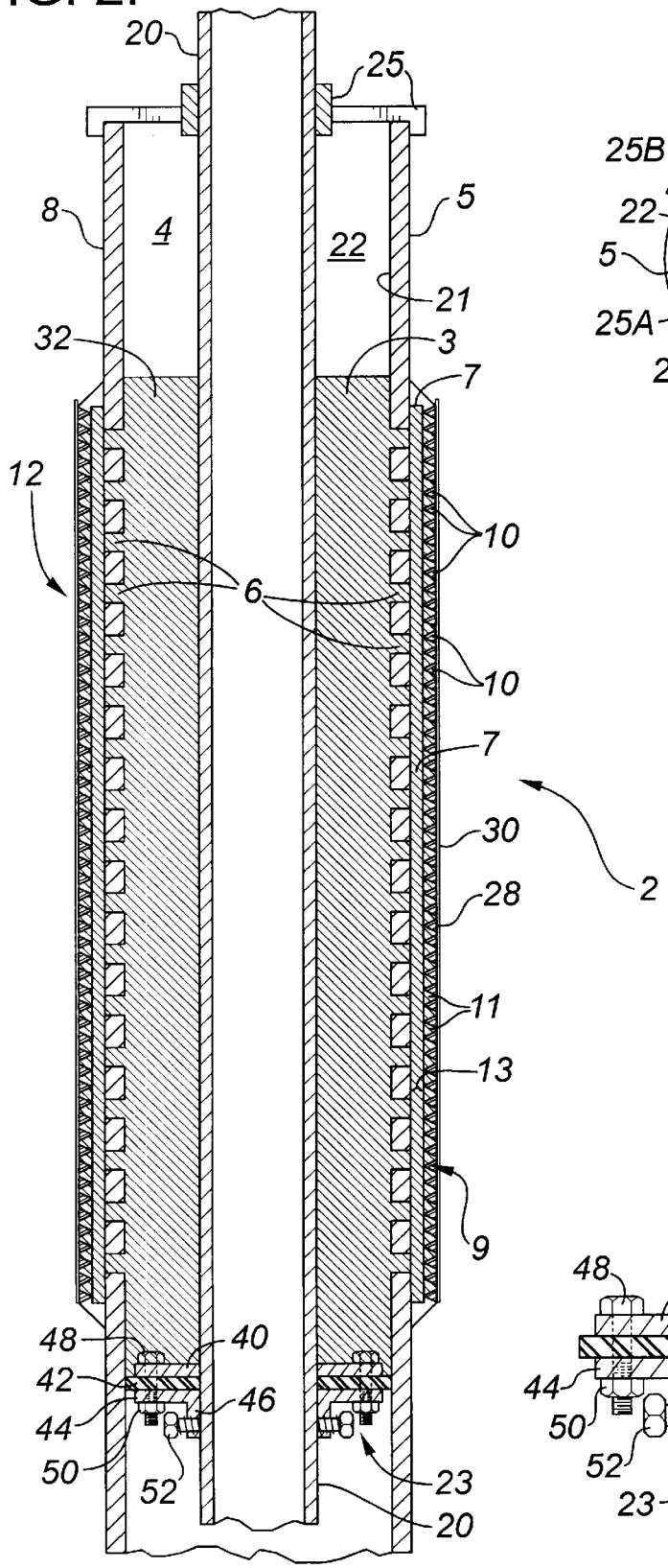
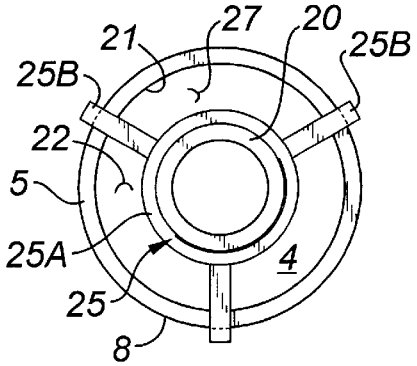
FIG. 3.
FIG. 4.
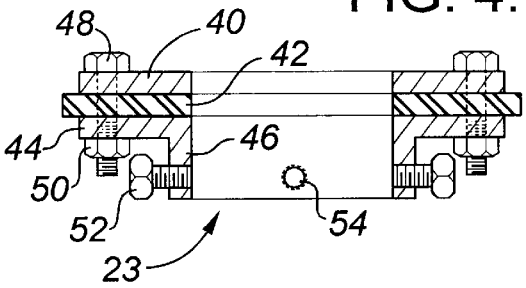

SAND EXCLUSION LINER AND METHOD OF USING THE SAME

FIELD OF THE INVENTION

This invention relates to a temporarily blinded sand exclusion liner and to the method for emplacing or landing the liner so that it is fully inserted into the desired position in the wellbore.

BACKGROUND OF THE INVENTION

Sand exclusion liners (also known as "sand control screens") are commonly used in wells producing from a sand formation or reservoir. These wells usually are completed "open hole". That is, the wellbore is drilled vertically down through the overburden to the top of the sand reservoir and cased. The end plug of the casing is then drilled out and the wellbore is whipstocked and drilled horizontally through the reservoir. The horizontal section of the wellbore is left uncased or "open hole". A perforated liner is then run into the well at the end of a pipe string and landed or positioned to extend from the end of casing through the horizontal section of the wellbore. The liner is sealed at its inner end to the casing's bottom end, so that the former is an extension of the latter. A production tubing string is then run into the well to extend into the liner bore.

The function of the liner is to allow produced fluid to enter the production string while simultaneously screening or rejecting mobilized sand grains seeking to enter with the fluid.

One specific, commercially available sand exclusion liner will now be described, by way of example. The liner is formed of tubular steel joints coupled together end to end by threaded couplings. Some of the joints have screen sections. The screened joints each comprise a base pipe having transverse perforations extending through the pipe side wall. Steel rods extend across the perforated section, parallel to the axis of the pipe. The rods are welded to the outside surface of the base pipe at spaced intervals around its circumference. A stack of vertically spaced apart steel rings is positioned over the rods; the rings are individually welded to the rods. The rings each have a generally triangular cross-section so that the slot, formed between a pair of adjacent, vertically spaced apart rings, has increasing width from the outside in. This is commonly referred as a "keyhole" opening or slot. In summary, the liner comprises one or more joints, some blank and some having a perforated base pipe carrying means for screening sand to prevent it entering the perforations.

The present invention was developed in connection with experimental wells in which liners were to be landed in horizontal wellbores completed in an unconsolidated sand reservoir.

Two problems needed to be addressed.

Firstly, the liner has a tendency to pile up sand ahead of it as it is advanced along the horizontal wellbore. Or alternatively sand may slump in around the liner. In both cases, it can become difficult or impossible to keep advancing the liner to get it fully inserted to the desired landing position. It is common oilfield practice to remove sand blockages by circulating oil or drilling fluid down through a non-perforated tubular string and out of the annulus or vice versa, to fluidize and remove the sand. However, in the case of a perforated liner, the circulating fluid will reverse prematurely through the perforations and not reach the end of the liner. Thus, circulating fluid to wash out sand blockages preventing full insertion of the liner in a horizontal wellbore is not available as a solution.

Secondly, it will be desirable in some cases to be able to keep the liner and the positioning string to which it is attached empty or "dry " when easing it into the horizontal section of the wellbore. If the liner/string unit is filled with the fluid filling the wellbore, then the liner will bear against the bottom surface of the horizontal wellbore section wall. Being heavy and with little string weight to help force it along, the liner is difficult to advance. If the liner/string unit can be kept empty, then buoyancy will assist in easing the liner along the horizontal wellbore.

With this background in mind, it was therefore one objective of the invention to modify a liner so that it could be "circulated into" the wellbore. It was a second preferred objective to provide a liner that could be "floated dry" into the wellbore.

SUMMARY OF THE INVENTION

In accordance with the invention, the side wall openings of each screened section of the liner are temporarily blinded with heat-liquefiable solid sealant. The sealant selected is capable of remaining solid and in place when exposed to reservoir temperature and pressure as well as circulating pressure, yet it will liquefy when contacted by steam, hot oil or water. By temporarily blinding the openings with a pressure-resistant sealant, circulation can thereafter be carried on through the full length of the assembled liner.

Suitable materials for use as the sealant are wax, asphalt or roofing tar. The preferred material is wax because it leaves no residue when liquefied or melted. Tests with a mixture of wax and roofing tar indicated that the seal would adequately hold pressure but tar residue after melting would partly block the screen openings. We have successfully used petroleum wax having a melting point of about 60° C. as the liner sealant in wells having a vertical depth of 160 meters and reservoir temperature and pressure of 8° C. and about 350 psi.

We have used two approaches in blinding the openings. In earlier experiments, an internal sleeve of sealant was formed by placing a tubular mandrel within the bore of an upstanding liner joint and pouring hot sealant into the annular space between the mandrel and joint. The sealant would penetrate out into the screen openings. On cooling, the mandrel would be extracted leaving a circulation bore extending through the sleeve. It was believed that the thick sleeve was needed to resist pressure. However, in later tests involving wax sleeves, the sleeve was bored out and the sealant in the openings was found to be adequately resistive to leakage under pressure.

Preferably, a one-way valve is attached to the leading end of the liner. This allows the liner to be run "dry" or empty into the fluid-filled wellbore. Buoyancy thus can assist in advancing the liner through the horizontal wellbore.

In one aspect, broadly stated, the invention comprises a method for landing a sand control liner in a horizontal wellbore penetrating a subterranean sand reservoir, comprising providing a tubular liner having first and second ends and a side wall forming screen sections having openings for enabling formation fluid to enter the bore while screening out sand carried by the fluid, said openings being temporarily blinded by a heat-liquefiable solid sealant; running the blinded liner into the wellbore on the end of a tubular string and, on encountering a sand blockage, circulating fluid through the full length of the blinded liner to remove the blockage; and when the liner has reached its landing position in the wellbore, then contacting the sealant with hot fluid (such as steam or very hot oil) to liquefy it and open the openings for the production of fluid.

In another aspect, broadly stated, the invention comprises a blinded sand control liner for running into a wellbore penetrating a fluid-producing subterranean sand reservoir, said liner having upper and lower ends, comprising: a tubular liner formed of joints connected end-to-end, some of the joints having transverse openings forming a screen section for admitting fluid and rejecting sand; heat-liquefiable solid sealant blinding the openings, said sealant being selected to remain solid and in place at circulating pressure but to liquefy when contacted by steam; said liner forming an open central longitudinal bore; and one way valve means, attached to the liner at its lower end, for preventing the ingress of fluid into the liner bore from its lower end but permitting fluid to be pumped through the valve means from the liner bore.

DESCRIPTION OF THE DRAWINGS

FIG. 2 is a side sectional view showing a blinded liner joint having a sleeve, together with the top centralizer, bottom sealing and centralizing cap and forming mandrel used in constructing the sleeve, with some structural details omitted to simplify the drawing;

FIG. 3 is a plan view of the top centralizer;

FIG. 4 is a side sectional view of the bottom cap;

DESCRIPTION OF THE PREFERRED EMBODIMENT

Figure 7:
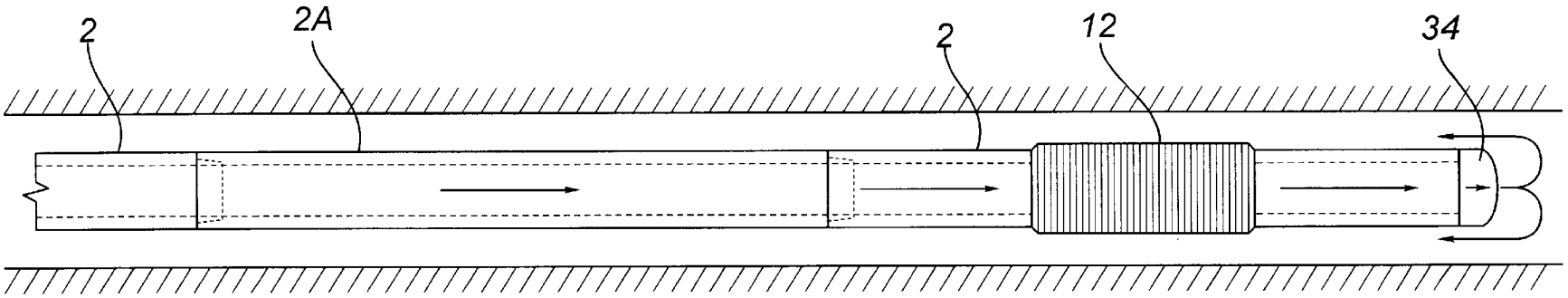
FIG. 7 is a side sectional view of the blinded liner equipped with a one-way valve, ready for running into the wellbore.

Having reference to FIG. 7, a blinded liner 1 comprises a series of screened joints 2, separated by blank joints 2*a*, connected together end-to-end by threaded connections. Each screened joint 2 has an internal, annular, solid sleeve 3 of sealant blinding its openings 4.

Figure 1:
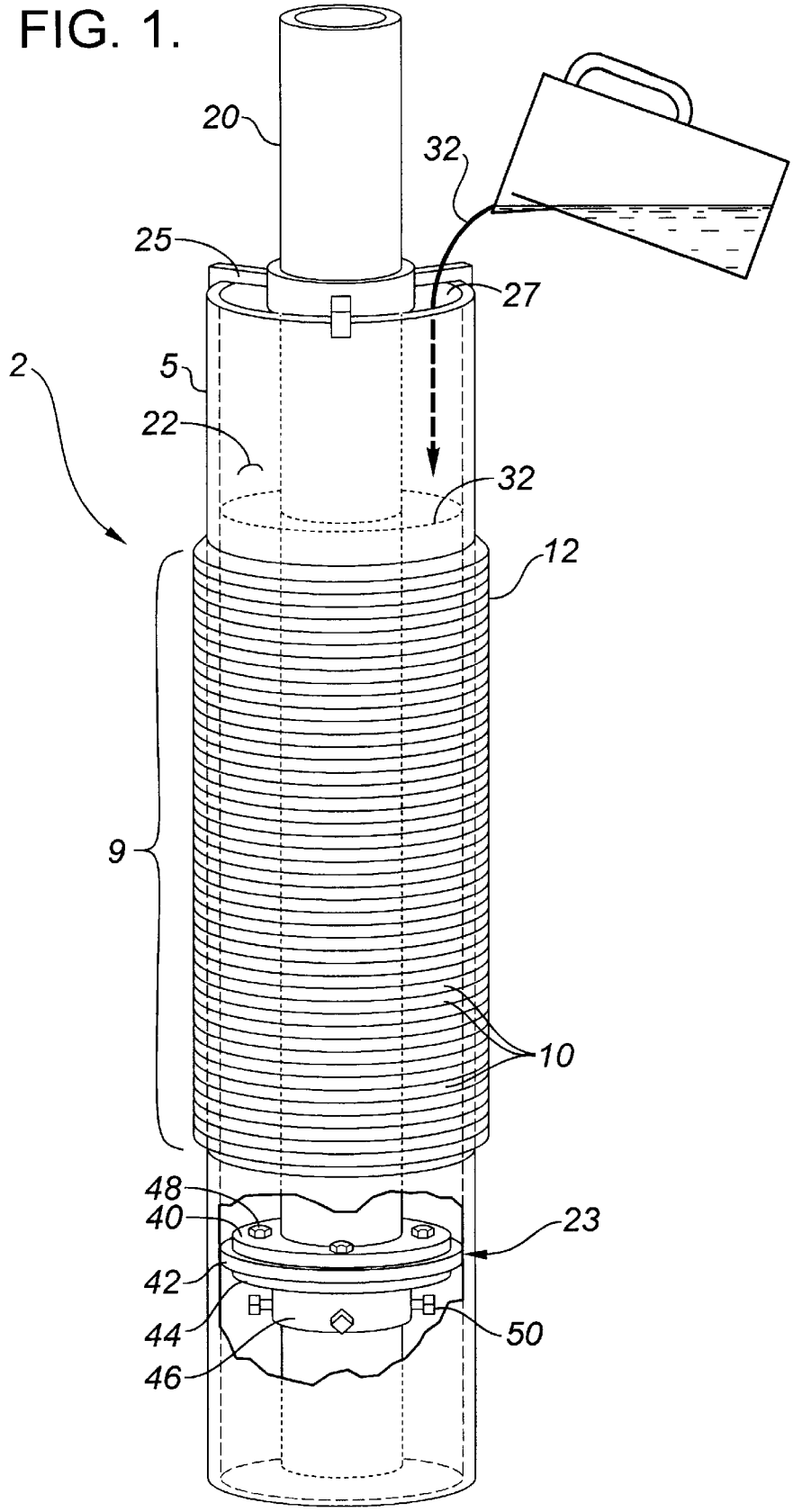
FIG. 1 is a schematic showing a method for constructing the blinded liner joint.
Figure 5:
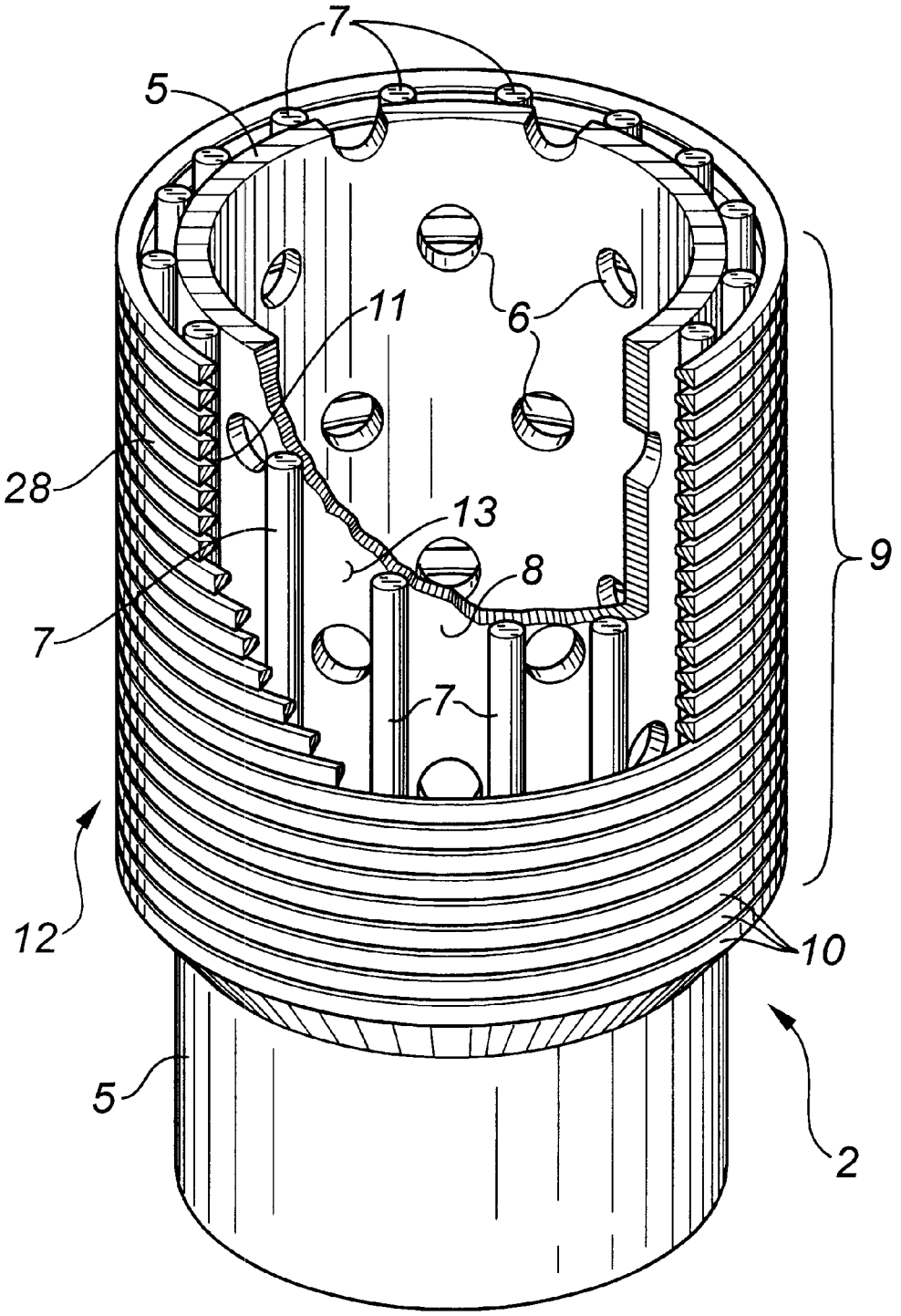
FIG. 5 is a partly broken away perspective view of the wire-wrapped screen section of the joint shown in FIG. 1.
Figure 6:
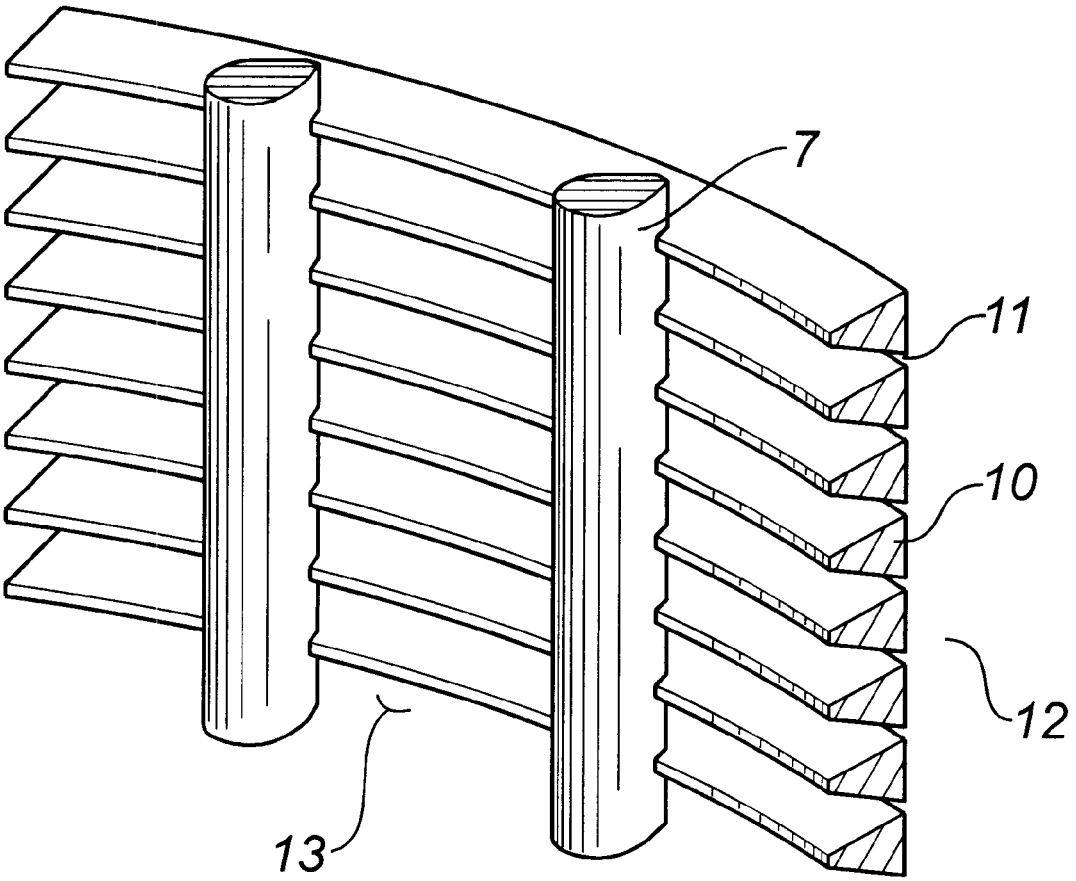
FIG. 6 is an expanded perspective view of the "wire wrap" and rods, showing keyhole apertures.

The liner joint 2 shown in FIGS. 2, 5 and 6 is conventional. It comprises a steel base pipe 5 having transverse perforations 6. Rods 7 are welded to the outside surface 8 of the base pipe 5. These rods 7 extend longitudinally of the base pipe at positions spaced around its circumference. A spirally wrapped steel wire 9 forming of vertically spaced apart steel rings 10 is positioned over the rods 7 and perforations 6. The rings 10 are welded to the rods 7. They have generally triangular cross-sections so that "keystone" apertures 11 are formed between them. In summary, the liner joint 2 comprises a perforated base pipe 5 carrying an external "wire wrap" screen 12 positioned over the perforations 6. (The term "openings" used in the claims is intended to mean the fluid passageways formed by the combination of the keystone apertures 11, spaces 13 between the rods 7 and perforations 6.) The keystone apertures 11 are operative to screen out or reject coarse sand grains carried with produced fluid.

To form or construct the sleeve 3, the following procedure is practiced. A tubular mandrel 20 is centrally positioned within the bore 4 of a vertically oriented joint so as to extend coaxially and longitudinally thereof. The mandrel 20 is inwardly spaced from the inside surface 21 of the base pipe 5, to cooperate therewith to form an annular space 22. The bottom end of the mandrel 20 rests on and is centered by the bottom cap 23, which is threaded onto the lower end of the base pipe 5. The bottom cap 23 seals the bottom of the annular space 22. A centralizer 25 has openings 27 so that liquid sealant may be poured into the annular space 22.

As previously stated, the preferred sealant is petroleum wax having a melting temperature of about 60° C.

The outside surface 28 of the screen 12 is wrapped with a wrapping 30 of silicon-coated paper held in place with duct tape. Hot liquid sealant 32 is poured into the annular space 22. The sealant penetrates the openings perforations 6, spaces 13 and apertures 11. On cooling, the sealant forms a solid sleeve 3 having "fingers" extending into and sealing the passageways. The sealant provides a liquid-tight seal. The solid sealant plugs within the tapered keystone apertures 11 are particularly resistive to displacement by internal pressure during circulation.

The mandrel 20 can then be loosened by heating it internally and removed, together with the centralizer 25. The bottom cap 23 is unscrewed from the base pipe 5. This leaves a central bore extending longitudinally through the sleeve 3.

In later tests, the sleeve 3 has been bored out and it has been determined that the "fingers" alone are adequate to provide the pressure-holding seal of the passageways, that is needed.

A one-way valve 34 is attached to the leading end of the first joint of the liner. The remaining joints are then connected and the liner is ready to be run into the wellbore.

Pressure Test

If fluid, such as water, oil or drilling mud is to be circulated through a blinded liner, there will be pumping pressure ("circulation pressure") acting on the fluid moving through the liner. The wells in which the liners were to be run were quite shallow, having a vertical depth of about 160 meters. These wells were being completed in the Athabasca oil sands in Alberta. It was therefore anticipated that the blinded liner would be subject to a pressure differential across the sealant-filled screen openings in the order of 200 psi.

It was desirable to bore out the sealant sleeve in each joint before running it into the wellbore, so the full diameter of the base pipe would be open. However, it was a concern that the fingers of sealant might blow out or leak if such internal pressure was applied.

Therefore, a pressure test was carried out on a wax-sealed, bored-out liner joint, to determine the strength of the seal.

More particularly, a blank coupling was threaded onto one end of the test joint and a coupling having a 2-inch inlet was threaded onto the other end. The joint was filled with water and pressure tested at 200 psig for 3 hours without leakage. The pressure was then increased to determine the upper limit for pressure containment—the seal did not leak until a pressure of about 800 psig was applied.

Field Test Involving Circulation

Wax-blinded liners were tested in a pair of wells extending horizontally about 750 meters into an unconsolidated oil sand at a depth of about 160 meters. The reservoir temperature and pressure were 8° C. and about 200 psi.

The wells were completed with about 750 meters of 7½ inch diameter wire-wrapped liners comprising 40 foot joints, each having about 10 feet of screen. In each case, the joints had been sealed with an internal sleeve of wax extending into the screen openings. The internal sleeve had been bored out before use in the well.

The liner for the first well was fully inserted without any need to circulate to clear sand blockages. Once in place, it was circulated with water to remove drilling fluid and observations of fluid return volumes and samples of water indicted that the wax seal remained in place throughout emplacement and circulation.

The second well provided proof that the wax sealed liner could be used to circulate drilling fluid and clear sand blockage from the wellbore. The liner was being run into the horizontal wellbore and had completed about 500 meters of the planned 750 meter insertion without incident with a modest "pulldown" force on the liner of about 7000 daN. At about the 540 meter point, a sand blockage was encountered and the pulldown force required jumped from 7000 daN to 30,000 daN, thereby ending any possibility of pushing the liner further into the wellbore. The liner was pulled back about 1 meter using a very high pullback force of 50,000 daN. Drilling fluid was then circulated in through the liner and out the annulus for about 0.5 hours. Running of the liner was then recommended. The liner moved forward into the well to the full depth of 750 meters with a pulldown force of 7000 daN. After full insertion, water was circulated through the liner. Observations of water returns indicated that the wax seal still remained in place after circulation to remove the sand blockage.

Field Test Involving Seal Removal

In another well, having a horizontal wellbore extending about 500 meters, a 7½ inch diameter wire-wrapped liner having blinded joints was inserted without incident. The blinded joints contained a wax sleeve having a 4-inch bore. After emplacement, the sleeve was bored out with a drill bit. Steam was then circulated through the liner and back up the annulus for 24 hours. After about 24 hours, the circulation pressure dropped, indicating that the screen openings were being cleared. Subsequently, the well was placed on production and oil was satisfactorily produced through the liner openings.

What is claimed is:

1. A method for landing a sand control liner in a horizontal wellbore penetrating a subterranean sand reservoir, comprising:

providing a tubular liner having first and second ends and a side wall forming screen sections having openings for enabling formation fluid to enter the bore while screening out sand carried by the fluid, said openings being temporarily blinded by a heat-liquefiable solid sealant;

running the blinded liner into the wellbore on the end of a tubular string and, on encountering a sand blockage, circulating fluid through the full length of the blinded liner to remove the blockage; and when the liner has reached its landing position in the wellbore, then contacting the sealant with steam to liquefy it and open the openings for the production of fluid.

2. The method as set forth in claim 1 wherein the sealant is selected to remain solid and in place at circulating pressure but, when contacted with steam, will liquefy.

3. The method as set forth in claim 2 wherein the sealant is selected from the group consisting of asphalt, tar and wax.

4. The method as set forth in claim 3 wherein the sealant is petroleum wax.

5. A blinded sand control liner for running into a wellbore penetrating a fluid-producing subterranean sand reservoir, said liner having upper and lower ends, comprising:

a tubular liner formed of joints connected end-to-end, some of the joints having transverse openings forming a screen section for admitting fluid and rejecting sand;

heat-liquefiable solid sealant blinding the openings, said sealant being selected to remain solid and in place at circulating pressure but to liquefy when contacted by steam;

said liner forming an open central longitudinal bore; and one way valve means, attached to the liner at its lower end, for preventing the ingress of fluid into the liner bore from its lower end but permitting fluid to be pumped through the valve means from the liner bore.

* * * * *